United States Patent [19]

Oba

[11] Patent Number: 4,647,032

[45] Date of Patent: Mar. 3, 1987

[54] SHEET DELIVERING DEVICE FOR BUSINESS MACHINE

[75] Inventor: Harutaro Oba, Shizuoka, Japan

[73] Assignee: Tokyo Electric Co., Ltd., Tokyo, Japan

[21] Appl. No.: 793,971

[22] Filed: Nov. 1, 1985

[30] Foreign Application Priority Data

Nov. 7, 1984 [JP] Japan ..... 59-234493

[51] Int. Cl.[4] ..... B65H 29/20

[52] U.S. Cl. ..... 271/186; 271/187; 271/315

[58] Field of Search ..... 271/186, 187, 315, 204

[56] References Cited

U.S. PATENT DOCUMENTS

| | | | |
|---|---|---|---|
| 3,409,290 | 11/1968 | Bergland | 271/187 X |
| 3,904,192 | 9/1975 | Pfeifer | 271/186 |
| 4,228,997 | 10/1980 | Schoonmaker | 271/315 |
| 4,275,874 | 6/1981 | DiBlasio | 271/187 X |

*Primary Examiner*—Richard A. Schacher

*Attorney, Agent, or Firm*—Oblon, Fisher, Spivak, McClelland & Maier

[57] ABSTRACT

A rotary body capable of holding the leading edge of a sheet is disposed after delivery rollers disposed on one side of a housing. The rotary body is rotated to place sheets one after another in a pile after turning-over each sheet. Since the sheets are turned over by the agency of the rotary motion of the rotary body, only a small space is necessary for providing a mechanism for turning-over the sheet.

4 Claims, 4 Drawing Figures

SHEET DELIVERING DEVICE FOR BUSINESS MACHINE

FIELD OF THE INVENTION

The present invention relates to a sheet delivering device for a business machine such as a printer or a copying machine.

BACKGROUND OF THE INVENTION

Generally, in a printer or a copying machine, the sheets delivered one by one are put sequentially one upon another with the printed surface thereof turned up. Accordingly, when a document is copied in the order of page from the first page to the last page, the delivered printed sheets are piled up sequentially in the reverse order of page with the printed surfaces thereof turned up.

Accordingly, the printed sheets need to be rearranged in the order of page for binding the printed sheets. In order to eliminate such an inconvenience, it may be effective to provide means for turning over every printed sheet before piling up the printed sheets so that the printed surface are turned down. However, such means lengthens the sheet conveying path, and hence the size of the printed or the copying machine is increased.

OBJECT OF THE INVENTION

It is a primary object of the present invention to provide a device capable of piling up printed sheets in the same order of page as the original document.

It is a second object of the present invention to shorten the sheet conveying path.

SUMMARY OF THE INVENTION

According to the present invention, delivery rollers are disposed on one side of the housing, and a rotary body, such as a belt, which is rotated at a circumferential speed lower than that of the delivery rollers, and a sheet tray are disposed after the delivery rollers. The rotary body is provided on the circumference thereof with projections extending backward with respect to the direction of rotation of the rotary body at an inclination to the circumference of the rotary body, while a stopping surface and a supporting surface are formed in the sheet tray.

Accordingly, the sheet delivered by the delivery rollers is held between the outer circumference of the rotary body and the projection as the rotary body rotates. The sheet held by the rotary body is brought into contact with the stopping surface, and thereby the sheet is separated from the rotary body, and then, the sheet thus separated from the rotary body is placed on the supporting surface. Thus, the printed sheet delivered with the printed surface turned up by the delivery rollers is turned over, and then the printed sheet is placed with the printed surface turned down on the supporting surface.

DETAILED DESCRIPTION OF PREFERRED EMBODIMENTS

Figure 1:
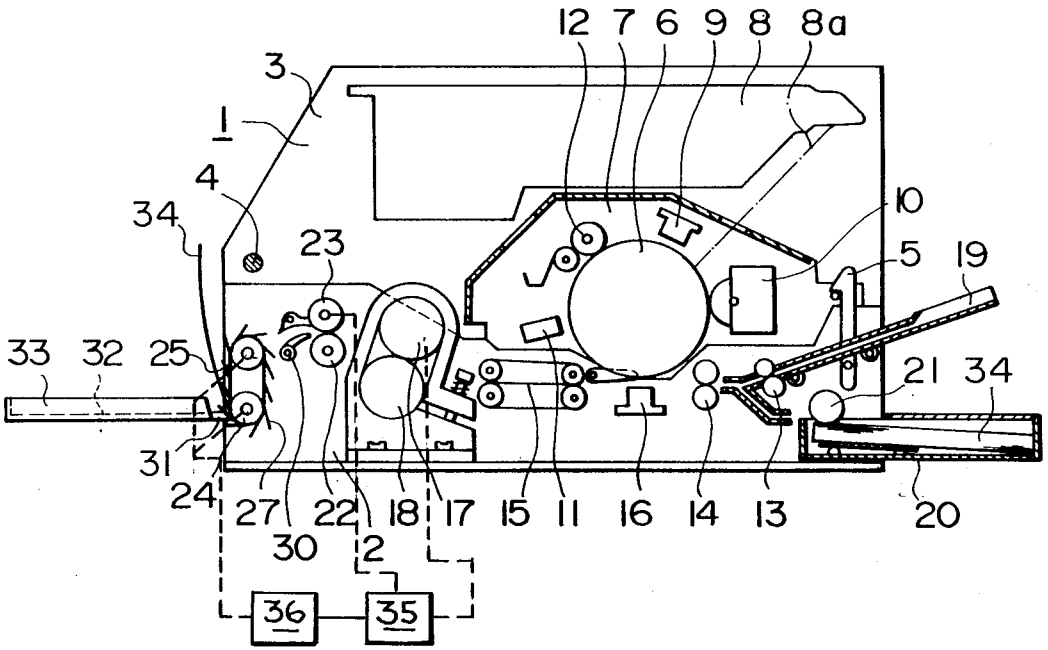
FIG. 1 is a partially sectional side elevation of a first embodiment of the present invention.
Figure 2:
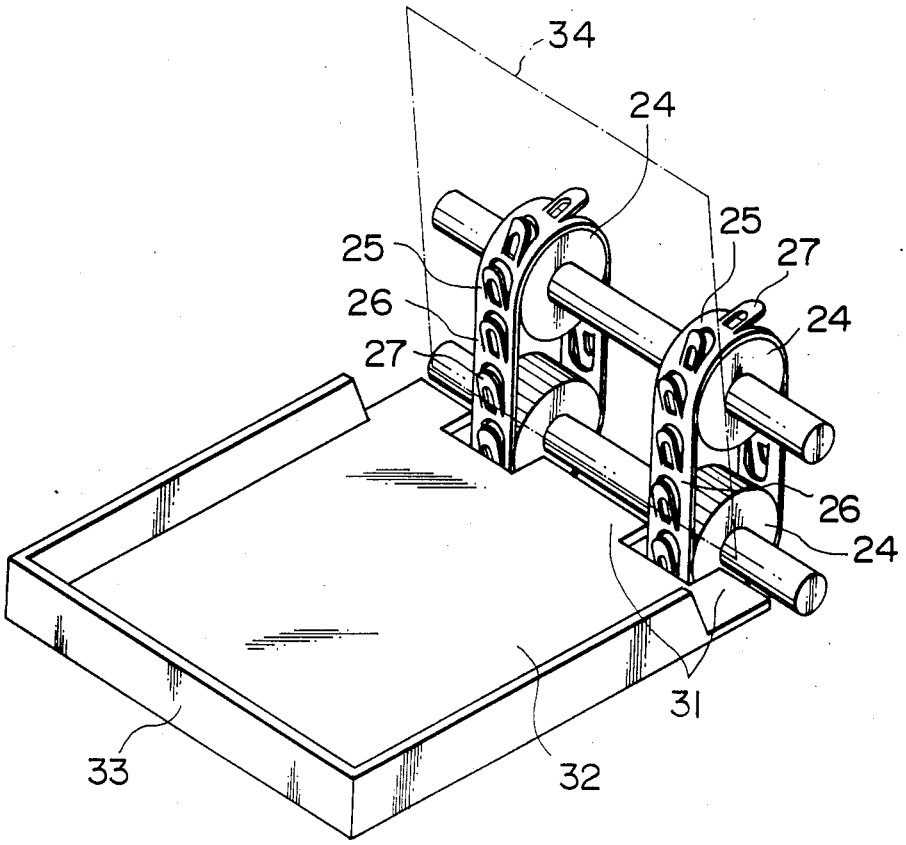
FIG. 2 is an enlarged perspective view of the essential portion of the first embodiment of FIG. 1.
Figure 3:
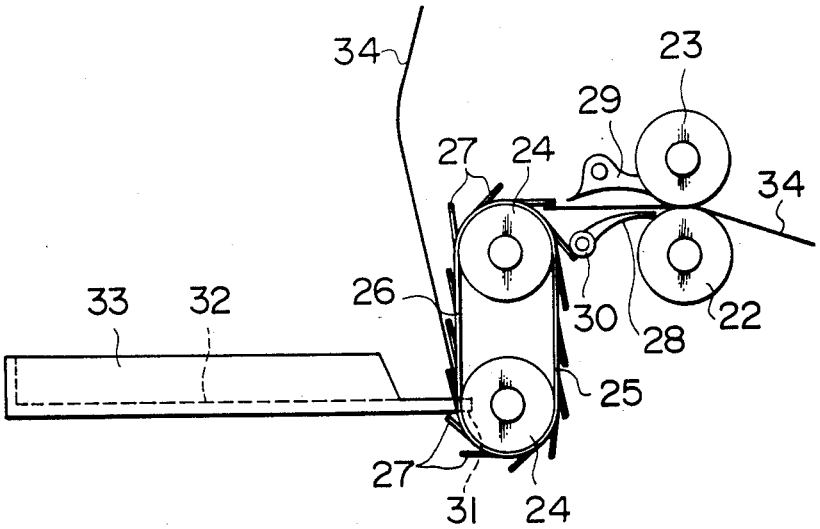
FIG. 3 is an enlarged side elevation of the essential portion of the first embodiment.

A first embodiment of the present invention will be described hereinafter with reference to FIGS. 1 to 3. A housing 1 comprises a base 2 and a cover 3 joined swingably to the base 2 with a supporting shaft 4. A latch 5 for fixing the cover 3 to the base 2 is provided on the opposite side of the base 2 with respect to the supporting shaft 4. A drum frame 7 rotatably holding a photosensitive drum 6, and a light source unit 8 are attached to the cover 3. A charger 9, a toner box 10, a lamp 11 and a cleaning roller 12 are held on the drum frame 7.

Feed rollers 13 and 14, a conveyor 15, a transfer charger 16, fixing rollers 17 and 18, a manual feeding unit 19, a cassette 20, sheet supplying roller 21 and delivery rollers 22 and 23 disposed one over the other are provided on the base 2.

Two pairs of pulleys 24, namely, two pairs of upper and lower pulleys, are disposed in the lower portion of the housing 1, namely, on one side of the base 2. A belt 25 is extended between each pair of the upper and lower pulleys 24. The belt 25 are formed of an elastic steel or an elastic plastic material. Portions of the belt are cut and raised to form a plurality of projections 27 so as to extend backward with respect to the direction of rotation of each belt 25 at an inclination to the outer circumference 26 of the belt 25. As shown in FIG. 3, the respective free ends of sheet guides 28 and 29 are resiliently in contact with the delivery rollers 22 and 23, respectively. On the other hand, a pressing part 30 is formed on the other side of the sheet guide 28 so as to interfere with the projections 27 below a common tangent to both the delivery roller 22 and the outer circumference of each belt 25. Furthermore, a sheet tray 33 having a stopping surface 31 and a supporting surface 32 is disposed outside the housing 1 with the stopping surface 31 extending beyond a vertical plane within which the outer side of the belts 25 move. The fixing roller 17, the delivery rollers 22, 23, and the pulleys 24 are driven by a common motor 35 through a change gear 36 so that the circumferential speed of the pulleys 24 and the belts 25 is lower than that of the delivery rollers 22.

In printing operation, the outer circumference of the photosensitive drum 6 is charged by the charger 9, the light source unit 8 radiates a laser beam 8*a* on the photosensitive drum 6 to form an electrostatic latent image, the toner is supplied from the toner box 10 to develop the electrostatic latent image, the delivery roller 22 draws out a sheet 34 from the cassette 20, the feed rollers 14 feed the sheet 34 to the outer circumference of the photosensitive drum 6, the toner image formed on the outer circumference of the photosensitive drum 6 is transferred to the sheet 34 by the agency of the transfer charger 16, the sheet 34 is conveyed by the conveyors 15, the fixing rollers 17 and 18 press the sheet therebetween, and then the delivery rollers 22 and 23 deliver the sheet 34 outside the housing 1, while the photosensitive drum is turned by one full turn. Then, the sheet 34 is held between the outer circumference 26 and the projections 27 of the belts 25. The sheet 34 is brought into contact with the stopping surface 31, and thereby the sheet 34 is turned over and placed on the supporting surface 32. When the preceding projection 27 is at a position for receiving the sheet 34 while the belt 25 is rotated, the following projection 27 is pressed by the pressing part 30 to expand the space between the two successive projections 27 to facilitate the entrance of the leading edge of the sheet 34 delivered by the delivery rollers 22 and 23. Since the sheet 34 is passed between the delivery rollers 22 and 23 with the printed surface turned up, the sheet 34 tends to wind around the upper delivery roller 23. Therefore, the sheet guide 29 is provided to separate the sheet 34 from the upper delivery roller 23. Thus, the sheet 34 delivered with the printed surface turned up is turned over by the belts 25, and the sheets 34 are piled up with the printed surface turned down on the sheet tray 33. Particularly, since the circumferential speed of the belts 25 is lower than that of the delivery rollers which is equal to the moving speed of the sheet 34, the sheet 34 when it is delivered to the belts 25 is bent in a curve between the belts 25 and the delivery rollers 22 and 23, which further ensures the turning-over of the sheet.

On the other hand, the lamp 11 irradiates the photosensitive drum 6 to erase the electrostatic latent image, and the cleaning roller 12 removes the residual toner adhering to the photosensitive drum 6.

Figure 4:
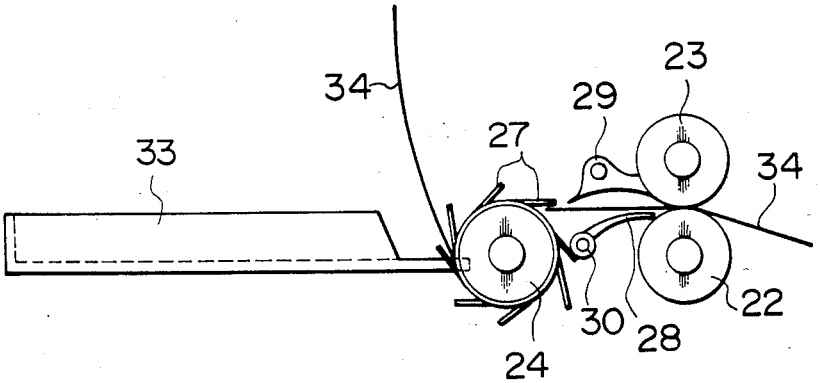
FIG. 4 is an enlarged side elevation of the essential portion of a second embodiment of the present invention.

A second embodiment of the present invention will be described hereinafter with reference to FIG. 4. In FIG. 4, the same parts as those of the first embodiment are designated by the same reference characters and the description thereof will be omitted. In this embodiment, the rotary body is a single pulley 24 integrally having projections 27 formed on the outer circumference thereof.

I claim:

1. A sheet delivering device for a business machine, said sheet delivering device comprising:

(a) a pair of delivery rollers for delivering sheets one at a time in succession in an at least substantially horizontal direction;

(b) first means for rotating said pair of delivery rollers at speeds such that the circumferential speeds of said pair of delivery rollers is a first speed;

(c) a pair of spaced rotary bodies, each one of said pair of spaced rotary bodies having an outer circumference and a plurality of spaced projections extending from the outer circumference obliquely backward with respect to the direction of movement of the outer circumference so as to hold the leading edge of each successive sheet delivered by said pair of delivery rollers between one of said plurality of spaced projections and the outer circumference, said pair of spaced rotary bodies being sized, shaped, and positioned so that the leading edge of each successive sheet delivered by said pair of delivery rollers is simultaneously held by both of said pair of spaced rotary bodies;

(d) second means for rotating said pair of spaced rotary bodies such that the circumferential speed of said pair spaced rotary bodies is a second speed, lower than said first speed; and (e) a sheet tray having (i) a stopping surface projecting between said pair of spaced rotary bodies, said stopping surface being sized, shaped, and positioned so that the leading edge of each successive sheet contacts said stopping surface when the sheet is at least approximately vertically oriented, and (ii) a supporting surface for supporting the sheets in a stack with a planar surface of the first sheet making planar contact with said supporting surfaces after each successive sheet has been turned over, said supporting surface being at least approximately horizontal and projecting away from said pair of spaced rotary bodies in a direction away from said pair of delivery rollers.

2. A sheet delivery device as recited in claim 1 wherein each of said pair of spaced rotary bodies is a belt trained over at least two spaced pulleys.

3. A sheet delivery device as recited in claim 1 wherein each of said pair of spaced rotary bodies is a single rotary wheel.

4. A sheet delivery device as recited in claim 1 and further comprising a pair of pressing parts disposed between said pair of delivery rollers and said pair of spaced rotary bodies, each one of said pair of pressing parts being sized, shaped, and positioned to press each successive one of said plurality of spaced projections on a corresponding one of said spaced rotary bodies away from the preceeding one of said plurality of spaced projections thereon to expand the space between the two projections, thereby facilitating the entrance of the leading edge of one of the sheets delivered by said pair of delivery rollers between the two projections.

* * * * *